United States Patent [19]

Ruf et al.

[11] 3,990,817

[45] Nov. 9, 1976

[54] ROTARY COMBUSTION ENGINE HAVING A MODIFIED TROCHOID

[75] Inventors: Max Ruf, Obereisesheim; Johannes Steinwart, Obersulm-Willsbach, both of Germany

[73] Assignee: Audi NSU Auto Union Aktiengesellschaft, Neckarsulm, Germany

[22] Filed: Feb. 6, 1976

[21] Appl. No.: 655,879

[30] Foreign Application Priority Data

Mar. 8, 1975 Germany ..... 2510149

[52] U.S. Cl. ..... 418/61 A; 418/150

[51] Int. Cl.[2] ..... F01C 1/02; F01C 21/10; F04C 17/02

[58] Field of Search ..... 418/61 A, 150; 123/8.45

[56] References Cited

UNITED STATES PATENTS

| | | | |
|---|---|---|---|
| 3,102,492 | 9/1963 | Bentele et al. | 418/61 A |
| 3,196,848 | 7/1965 | Bensinger | 418/61 A |
| 3,270,720 | 9/1966 | Ehrhardt | 418/61 A |
| 3,465,729 | 9/1969 | Jones | 418/61 A |
| 3,860,366 | 1/1975 | Haglund et al. | 418/61 A |

FOREIGN PATENTS OR APPLICATIONS

| | | | |
|---|---|---|---|
| 1,158,317 | 11/1963 | Germany | 418/61 A |
| 1,164,746 | 3/1964 | Germany | 418/61 A |

*Primary Examiner*—John J. Vrablik

*Attorney, Agent, or Firm*—Victor D. Behn; Arthur Frederick

[57] ABSTRACT

A rotary combustion engine comprising a housing having an inner trochoidal surface and a rotor mounted within the housing and having apex portions having sealing cooperation with said trochoidal surface to form a plurality of working chambers therebetween and in which said trochoidal surface is modified at least in the region at the ends of its minor axis by displacing said surface outwardly in this region to avoid the usual crest in each of these regions and further in which the rotor periphery is modified so that it is substantially the inner envelope of this modified trochoidal surface.

5 Claims, 8 Drawing Figures

10
12
14
16
18
20
22
24
26
28
30
40
42
44
48
50
1
1

10
16
18
20
22
24
26
28
30
30a
31
32
33
34
36
38
40
44
46
46a
56
54
60
X
Y
E
E'
F
F'
R
a
e
2
2

FIG. 3
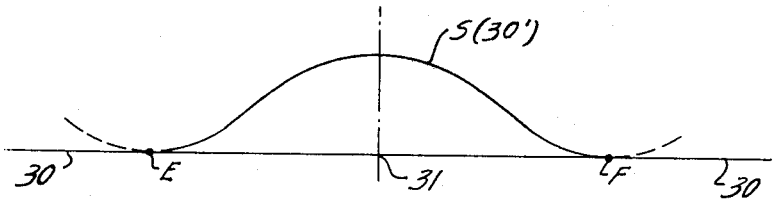
FIG. 4
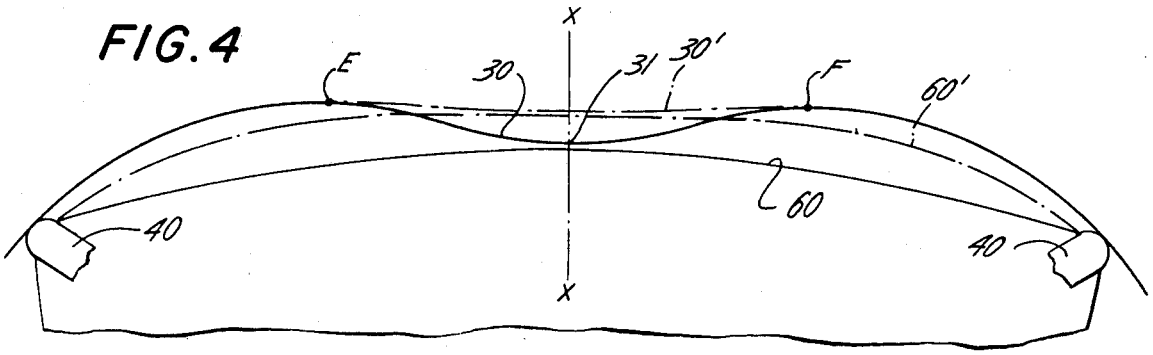
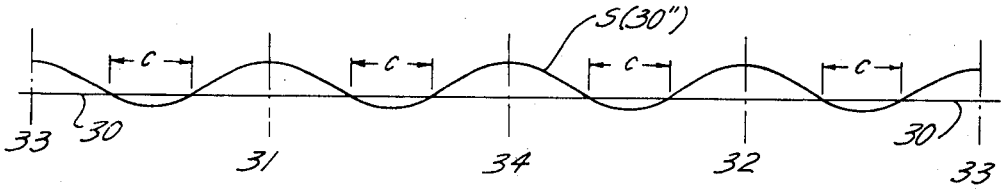
FIG. 5
FIG. 7
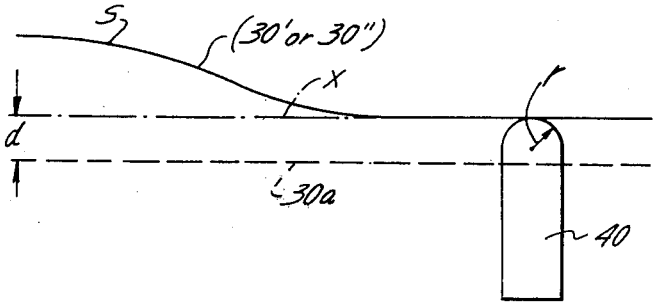
FIG. 8
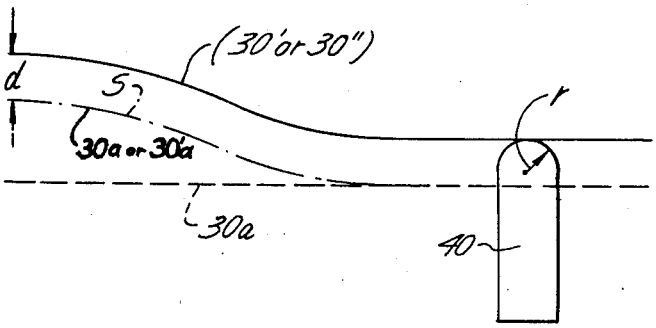

ROTARY COMBUSTION ENGINE HAVING A MODIFIED TROCHOID

BACKGROUND OF THE INVENTION

The invention concerns a rotary mechanism of the trochoidal type such as shown in U.S. Pat. No. 2,988,065 granted June 13, 1961 to Wankel et al. Such a rotary mechanism comprises an outer body or housing having two end housing parts and an intermediate or rotor housing part within which a rotor is mounted on the eccentric portion of a shaft extending coaxially through the housing. The inner surface of the rotor housing of such a rotary mechanism is substantially an epitrochoid. Also, the peripheral surface of the rotor approximates the inner envelope of this trochoidal surface, sufficient clearance being provided between the rotor periphery and the trochoid surface to avoid mechanical interference therebetween. As disclosed in said prior patent, the epitrochoid surface may have two lobes in which case the rotor has three apex portions and rotates at one-third the speed of the eccentric shaft.

Such a rotary mechanism may, for example, be operated as a rotary combustion engine as well as a compressor or expansion motor. The shape of the epitrochoid surface determines the maximum compression ratio of such a rotary mechanism. This shape of the epitrochoid is determined by the ratio R to *e* where R is the epitrochoid generating radius, that is, the radial distance from the center of the rotor to the tip of its apex portions, and *e* is the distance between the axis of the rotor and the axis of the engine shaft. This ratio (R/*e*) is generally known as the "K" factor. Higher compression ratios can be obtained by increasing the K factor of the epitrochoid surface.

As disclosed in said prior patent, a rotary mechanism in which the epitrochoid has a relatively large K factor has several drawbacks. For example, with a larger K factor the engine size must be increased in order to provide an engine with working chambers of a given size. Also, as the K factor is increased, the diameter of the engine shaft must be decreased.

For the purpose of increasing the available compression ratio but without the aforementioned difficulties, it is known in the prior art to start with a trochoid having a relatively low K factor and then for the purpose of increasing the compression ratio the trochoid is modified by displacing it outwardly in the region of the trochoid minor axis and the periphery of the rotor is modified so that the rotor periphery substantially corresponds to the inner envelope of the modified trochoid. Such a prior art rotary mechanism is disclosed in German Pat. No. 1,158,317 granted Nov. 28, 1963 to Klockner-Humboldt-Deutz and German Pat. No. 1,164,746 granted Mar. 5, 1964 to Klockner-Humboldt-Deutz. In this latter German patent, each of said modified portions of the trochoid surface comprises a circular arc. In this way it is possible to increase the compression ratio without increasing the trochoid K factor.

With this modified trochoid construction of said German patents there is an abrupt change in the radial acceleration or jerk of the apex seals as the seals move over the beginning and end of the modified portions of the trochoid surface. This abrupt change in acceleration of the apex seals could cause vibration of these seals relative to rotor and trochoid surface. Also, such a modification of the trochoid surface results in considerable radial movement of the rotor apex seals as they move over the modified portions of the trochoid surface in order for these seals to maintain contact with said surface.

Theoretically, radial motion of the rotor apex seals does not occur if the trochoid surface iss made in the form of a parallel curve spaced radially outwardly from a true epitrochoid a distance equal to the radius of the tip of each apex seal of the rotor. Such a parallel curve trochoid construction is disclosed in U.S. Pat. No. 2,988,008 granted June 13, 1961 to Wankel.

SUMMARY OF THE INVENTION

It is an object of the invention to provide a rotary mechanism of the type described in the aforementioned Wankel et al. patent and in which the compression ratio is increased by modifying the shape of the trochoid surface but in which the disadvantages resulting from the modified trochoid construction of said German patents is minimized.

In accordance with one form of the invention, the basic trochoid surface is modified in the region 20° to 30° on each side of the trochoid minor axis by displacing the trochoid surface radially outwardly in this region. This radially outward displacement is accomplished by superimposing a sine curve (or some other continuous curve) on this basic trochoid surface in such a way that two adjacent minima of said curve are located at the points or opposite sides of the trochoid minor axis at which the trochoid modification begins and ends and the maximum of said curve between said minimum is located on said minor axis such that at said points at which the trochoid modification begins and ends the second derivative of the equation of the basic trochoid surface and the equation of the superimposed curve are equal, or, at least, approximately equal. Also, in accordance with the invention, the rotor periphery is modified so that it corresponds substantially to the inner envelope of the modified trochoid surface.

With this modified trochoid construction, the acceleration or jerk of each apex seal strip at the transition of the basic trochoid surface to its modified portion can be made very small or even zero. This embodiment of the invention has a disadvantage in that the maximum volume of the working chambers of the rotary mechanism is reduced because the modified rotor periphery is displaced outwardly from its basic periphery in order to provide the higher compression ratio obtainable with the modified trochoid surface. As a result, the induction or swept volume of each working chamber is reduced.

To avoid this latter minor disadvantage, in a further form of the invention, the basic trochoid surface has a sine curve (or other curve which is continuous in its first and second derivatives) superimposed on it for its entire periphery of the trochoid surface such that the maxima of said curve are situated at each end of both the trochoid minor axis and the trochoid major axis. Also, the outer periphery of the rotor is modified or displaced outwardly so that it corresponds substantially to the inner envelope of the modified trochoid. With this embodiment of the invention, since the basic trochoid surface is displaced radially outwardly at the end of the trochoid major axis as well as at the ends of the trochoid minor axis, the outward displacement of the rotor periphery does not result in a decrease in the induction volume of each working chamber. Also, as in the first described form of the invention, there is little or no acceleration or jerk of the rotor apex seals.

In the case of a four-cycle rotary combustion engine, instead of using the construction of the invention to increase the compression ratio, the combustion recess in each working face of the rotor may be increased so that this recess forms a greater proportion of the minimum volume of each working chamber. With this construction, a greater volume of the combustible mixture can be placed in each combustion recess for ignition thereby improving the combustion efficiency.

As noted above in connection with the aforementioned German patents, the deviation or modification of the basic trochoid surface results in radial motion of the rotor apex seals in order for said seals to maintain contact with the trochoid surface. Where the basic trochoid surface is an outer parallel curve to a true epitrochoid and this basic trochoid surface is modified in accordance with the invention, it has been found that this radial motion of the apex seal strips can be reduced, if the spacing between the parallel curve and the true epitrochoid is made greater than the radius of the arcuate tips of the rotor apex seals. In contrast, in said prior U.S. Pat. No. 2,988,008 to Wankel, the spacing between an outer parallel curve and the true epitrochoid is equal to the radius of the arcuate tips of the rotor seals. The same reduced radial motion of the apex seals can be achieved if a true epitrochoid is first modified in accordance with the invention and then if an outer parallel curve to this modified epitrochoid is used for the actual trochoid surface and if the spacing between this parallel curve and this modified epitrochoid is made greater than the radius of the arcuate tips of the rotor apex seals.

Other objects of the invention will become apparent upon reading the following detailed description in connection with the drawings.

BRIEF DESCRIPTION OF THE DRAWINGS

FIG. 3 is a schematic representation of the manner in which the epitrochoid in the two regions adjacent the ends of its minor axis is modified in accordance with the invention by superimposing a sine curve;

FIG. 4 is a partial view of a rotary mechanism in which the inner trochoid surface of the rotor housing is modified in accordance with FIG. 3 and the rotor outer periphery is modified so that it is approximately the outer envelope of said modified trochoid surface;

FIG. 5 is a schematic representation similar to FIG. 3 but showing a sine curve superimposed around the entire periphery of the inner trochoid surface of the rotor housing;

FIG. 7 is a schematic enlarged view showing the relation of a rotor apex seal to the inner trochoid surface of a rotor housing in which said trochoid surface is obtained by modifying an outer parallel surface to an epitrochoid surface in accordance with FIGS. 3 or 5; and FIG. 8 is a schematic view similar to FIG. 7 in which the rotor housing trochoid surface is obtained by first modifying an epitrochoid surface in accordance with FIGS. 3 or 5 and then providing an outer parallel curve to the modified epitrochoid.

DESCRIPTION OF PREFERRED EMBODIMENTS

Figure 2:
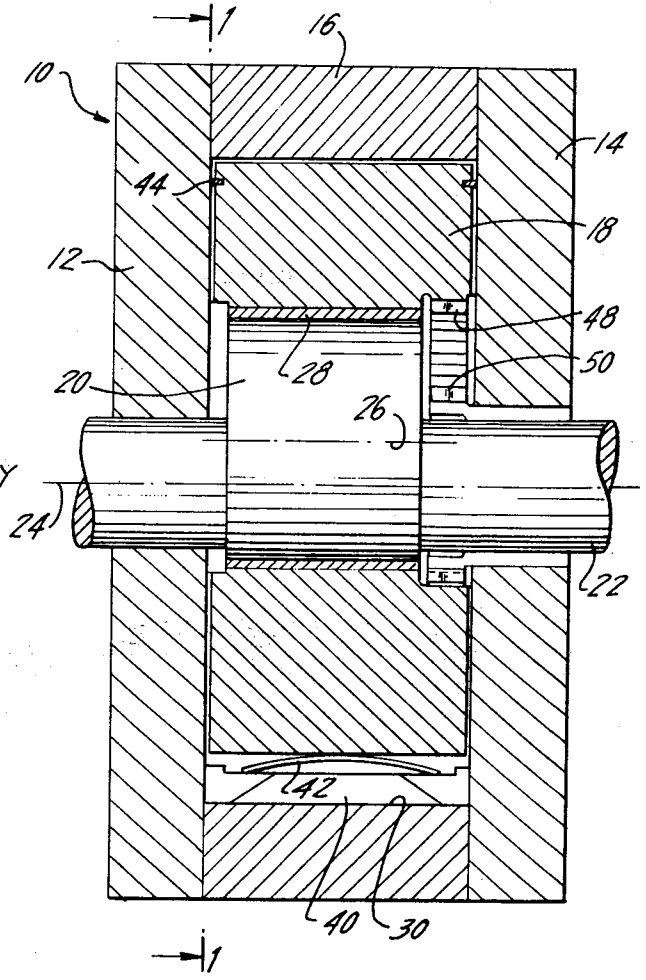
FIG. 2 is a section taken along line 2—2 of FIG. 1.
Figure 1:
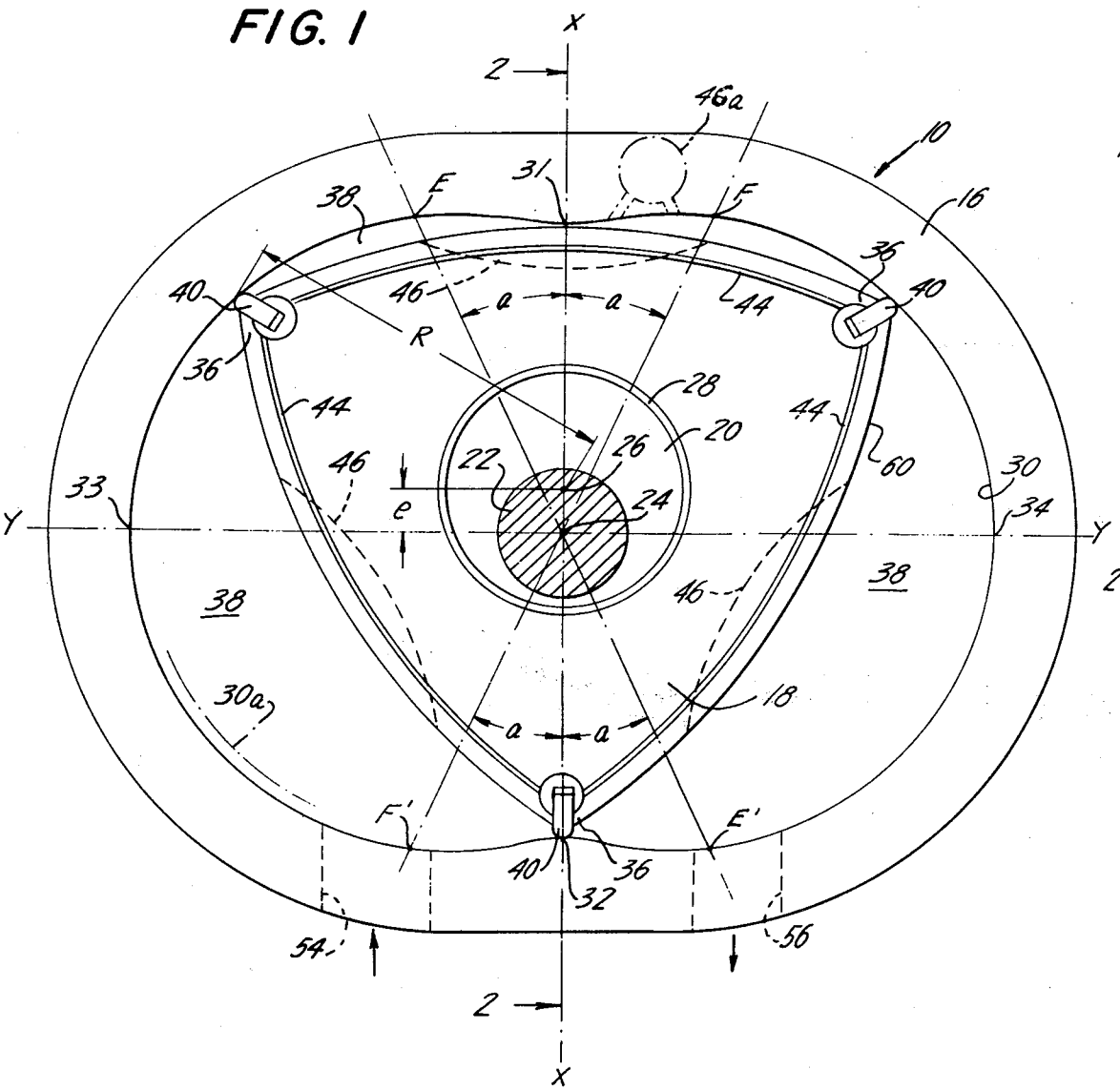
FIG. 1 is a schematic view of a conventional rotary combustion engine in which the inner surface of the rotor housing is an outer parallel curve to an epitrochoid.

FIGS. 1 and 2 disclose a conventional rotary combustion engine 10 of the type disclosed in aforementioned U.S. Pat. No. 2,988,065 to Wankel et al. As illustrated, the engine 10 comprises an outer body or housing consisting of two axially spaced end housings 12 and 14 and an intermediate or rotor housing 16, said housings being secured together to form an engine cavity therebetween. An inner body or rotor 18 is journaled for rotation within the housing cavity on an eccentric portion 20 of a shaft 22 which extends coaxially through and is supported by the end housings 12 and 14. The axis of said shaft 22 is indicated at 24 and that of the rotor 18 and the shaft eccentric 20 is indicated at 26. A sleeve bearing 28 preferably is provided between the rotor 18 and the shaft eccentric 20.

The peripheral inner surface 30 of the rotor housing 16 is illustrated as having a two-lobe profile which is substantially an epitrochoid having a minor axis $x—x$ intersecting the trochoid surface at the points 31 and 32 and a major axis $y—y$ intersecting the trochoid surface 30 at the points 33 and 34. The rotor 18 has three apex portions 36 each of which has sealing cooperation with the trochoidal surface 30 to form three variable volume working chambers 38 therebetween. The two circumferential ends of each working chamber 38 are sealed by radially movable seal means 40 disposed in grooves extending axially across each rotor apex portion 36. A spring 42 under each apex seal means urges it radially outwardly into engagement with the trochoid surface 30. Each side of the rotor 18 is provided with seal strips 44 diposed adjacent to the rotor periphery and extending between adjacent apex portions 36 of the rotor to further seal the engine working chambers 38. Each working face of the rotor 18 has a trough-like recess 46 forming the major portion of the combustion space. Also, the rotor 18 has an internal gear 48 thereto and disposed in mesh with an external gear 50 secured to the end housing 14. The gears 48 and 50 have a gear tooth ratio of 3 to 2 whereby the rotor 18 rotates about its axis 26 at one-third of the rotative speed of the shaft 22.

The structure so far described would be suitable, with appropriate porting, for use as a compressor, expansion motor and as an internal combustion engine. As illustrated, in the case of an internal combustion engine and with the rotor turning clockwise, as viewed in FIG. 1, the engine is provided with an intake port 54 and an exhaust port 56 disposed on opposite sides of the lower end 32 of the trochoid minor axis $x—x$. Combustion takes place in the working chambers 38 at the opposite or upper end 31 of the trochoid minor axis $—x$. For this purpose a spark plug (not shown) may be provided in the rotor housing 16 adjacent to said upper end of the minor trochoid axis $x—x$ in the case of a spark-ignited combustion engine. In the case of a Diesel engine, combustion is initiated as a reslt of the heat of compression adjacent said upper end of the trochoid minor axis $x—x$. If the rotary mechanism were designed for compressor operation, then a pair of inlet ports would be provided adjacent each end of the trochoid minor axis $x—x$ on the downstream side of said axis ends, and a pair of outlet ports would be provided also adjacent each end of the trochoid minor axis $x—x$ but on the upstream side of said axis ends. The trochoid surface 30 preferably is an outer curve parallel to a true two-lobed epitrochoid partially indicated at 30*a* in FIG. 1. The structure of the rotary mechanism 10 so far described is conventional.

In order to obtain as high a compression ratio as possible, the outer periphery 60 of the rotor 18 approximates the inner envelope of the trochoidal surface 30. Actually, the outer periphery 60 of the rotor 18 must be slightly smaller than the inner envelope of the surface 30 to avoid mechanical interference between the rotor 18 and said surface which might result, for example, because of manufacturing tolerances and bearing clearances. The maximum magnitude of the compression ratio obtainable in this manner depends on the K factor of the epitrochoidal surface 30. As previously described, the K factor is equal to the ratio of R over *e*, where as shown in FIG. 1, R is the radial distance from the center or axis 26 of the rotor 18 to the tip of a rotor apex seal 36 and *e* is the eccentricity of the rotor axis, that is, *e* is equal to the distance between the rotor axis 26 and the shaft axis 24.

As this K factor is increased, the theoretical maximum compression ratio obtainable increases. For example, for Diesel operation a compression ratio of about 15.6 to 19.5 is suitable. Such a compression ratio is theoretically obtainable with a K factor of between 6.2 and 7.5. Actually, however, since in order to avoid mechanical interference, the outer periphery 60 of the rotor 18 cannot correspond exactly to the inner envelope of the trochoidal surface 30 and because a combustion space or recess 46 is provided in each working face of the rotor 18, it is not readily possible to obtain such high compression ratios. In other rotary engines, a combustion space 46*a* has been provided in the rotor housing 16 as schematically indicated in dot and dash outline in FIG. 1 which would also make it difficult to obtain such high compression ratios. In general, rotary engines such as the engine 10 and having a K factor of between 6.2 and 7.5, are made with compression ratios of only about 8.5 to 9.5 with the combustion space 46 or 46*a* being about 55 percent of the minimum volume of each working chamber 38.

For the purpose of increasing the compression ratio of such a rotary combustion engine without increasing the K factor, the rotor housing trochoidal surface 30 is displaced radially outwardly in the region of each end of the trochoidal minor axis $x—x$ (that is, at the relatively near axis points 31 and 32) and the outer peripheral surface 60 of the rotor 18 is modified so that it is substantially the inner envelope of the thus modified trochoid but, with he rotor 18 having no mechanical interference with the modified trochoid surface.

In accordance with a first form of the invention, the trochoid surface 30 of FIG. 1 is modified by superimposing a sine curve or some other curve having successive maxima and minima points and for which the first and second derivatives are continuous on the basic trochoid surface 30 between the points E and F on opposite sides of one end of the trochoid minor axis $x—x$ (near-axis point 31) and is similarly modified between the points E′ and F′ on opposite sides of the other end of the trochoid minor axis $x—x$ (near-axis point 32). The points E and F and E′ and F′ are symetrically spaced on opposite sides of the minor axis $x—x$ so that the angle *a* about the axis 24 between the minor axis $x—x$ and each of the radii to the points E, E′, F and F′ is about 20° to 30°.

This superimposing of a sine curve on the basic trochoid surface 30 is done in such a manner that two adjacent minima of the sine curve are loated at the points E and F (and at E′ and F′) and so that the intermediate maximum of said curve is on the minor axis $x—x$, the trochoid surface 30 being displaced radially outwardly at each position between the points E and F (and between the points E′ and F′) by an amount equal to the ordinate of the sine curve at that position.

FIG. 3 is a schematic representation of the manner in which the trochoid surface 30 is modified between the points E and F. In order to clearly show the sine curve *s* and its relation to the trochoid surface 30, the portion of the trochoid surface 30 between the points E and F is indicated as a straight line in FIG. 3. As there shown, the superimposed sine curve *s* has two adjacent minima at the points E and F and has a maximum at the point 31 on the minor axis $x—x$. Between the points E and F the trochoid surface 30 is displaced outwardly in accordance with the ordinates of the sine curve at each position between the points E and F whereby in FIG. 3 said sine curve also represents the modified trochoid 30′ between the points E and F. The trochoid surface 30 is similarly modified between the points E′ and F′. In this way the second derivative of the equation of the trochoid surface 30 and of the equation of the superimposed curve are approximately equal at the points E and F (and at the points E′ and F′) whereby there is little or no acceleration or jerk of the apex seals as they move over transition points between the basic trochoid surface 30 and its modified portions 30′.

As already stated, the outer periphery of the rotor 18 is modified so that is substantially the inner envelope of the thus modified trochoid surface 30′. The relation of the modified trochoid 30′ and the thus modified rotor periphery 60′ to the original or basic trochoid surface 30 and rotor periphery 60 is illustrated in FIG. 4. It is clear from FIG. 4 that the modified outer periphery 60′ of the rotor 18 particularly at the region between the points E and F is far better fitted to the modified trochoid 30′ than the original rotor periphery 60 was fitted to the original trochoid surface 30. For reasons of clarity, these differences are exaggerated in FIG. 4. At the trochoid minor axis $x—x$, the difference or radial distance between the original trochoid surface 30 and the modified trochoid surface 30′ is equal to the amplitude (maximum ordinate) of the sine curve *s* which is added to or superimposed on the original trochoid surface 30. For a rotary mechanism in which $R = 116$ mm and $e = 17$ mm, this difference or distance at the axis $x—x$ may amount to only about 2 to 3 mm. With such a construction, the attainable compression ratio is substantially increased or, for a particular compression ratio of, for example, 8.5, the portion of the volume of the combustion space or recess 46 to the minimum volume of a working chamber 38 can be increased by about 65 percent to increase combustion efficiency.

In another form of the invention, the basic or original trochoid surface 30 is modified by superimposing a sine curve (or other curve having successive maxima and minima points and for which the first and second derivatives are continuous) for the entire periphery of said surface 30 so that the maxima of said curve are disposed outside of said surface 30 at each end of both the minor trochoid axis $x—x$ and the major trochoid axis $y—7$. FIG. 5 is a schematic view similar to FIG. 3 but illustrating this latter form of the invention. As in the schematic representation of FIG. 3, in order to clearly show the sine curve and its relation to the trochoid surface 30, said surface 30 is shown as a straight line in FIG. 5. The sine curve $s$ in FIG. 5 thereby represents the modified trochoid surface 30"

As shown in FIG. 5, the sine curve $s$ modifies the trochoid surface 30 about its entire periphery with the maxima of the sine curve being located at the ends of the trochoid minor axis $x—x$ (near-axis points 31 and 32) and trochoid major axis $y—y$ (remote-axis points 33 and 34). The trochoid surface 30 is displaced radially outwardly at each position therealong by an amount equal to the ordinate of the sine curve at that position except that in the regions designated $c$ the trochoid surface may be displaced radially inwardly as indicated in FIG. 5.

Figure 6:
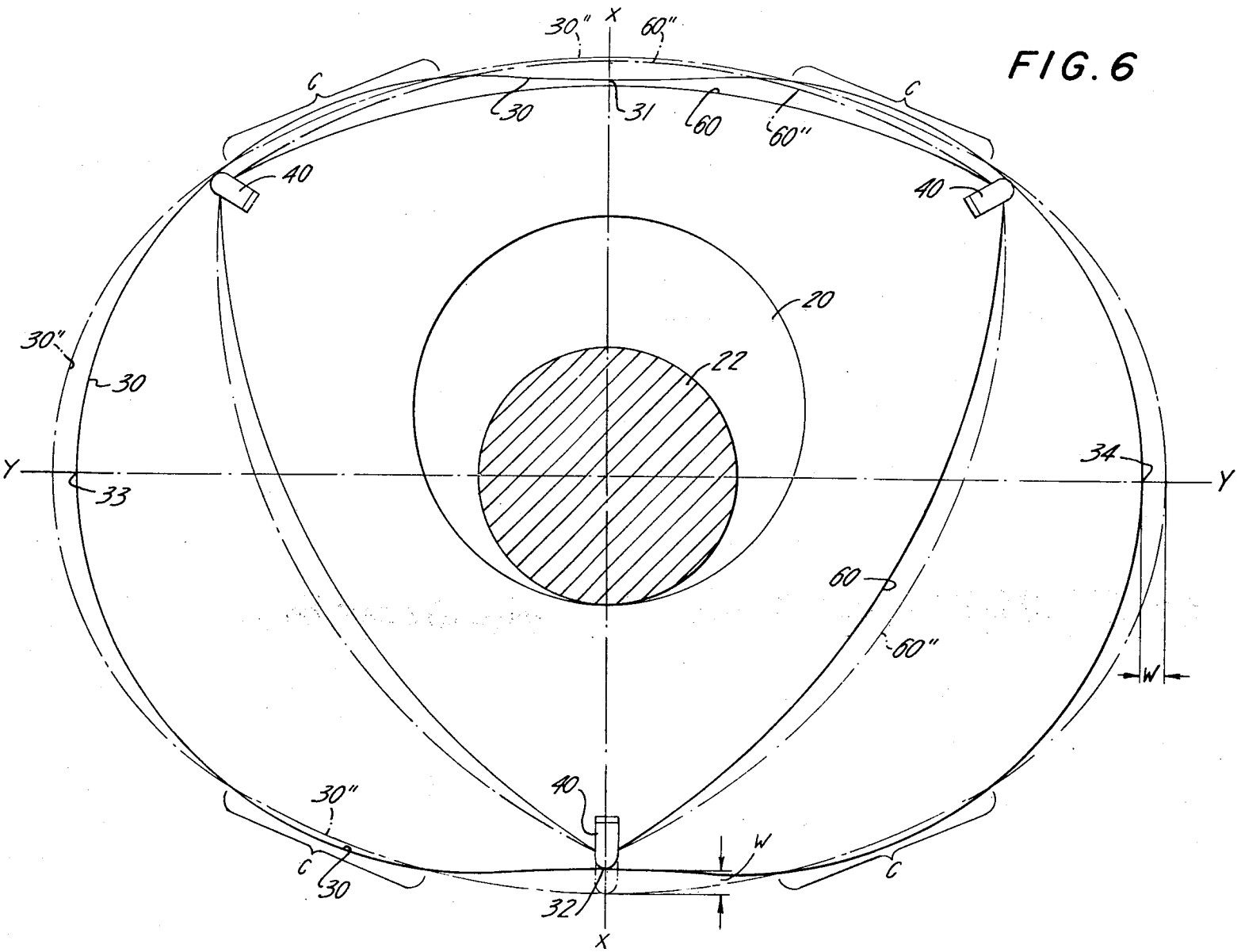
FIG. 6 is a view of a rotary mechanism in which the inner trochoid surface of the rotor housing is modified in accordance with FIG. 5 and also showing the rotor outer periphery modified so that it is approximately the outer envelope of the modified contour of the trochoid surface of the rotor housing.

The outer periphery of the rotor 18 is modified so that it is substantially the inner envelope of the trochoid surface 30" modified as in FIG. 5. The relation of the modified trochoid surface 30" and the thus modified rotor periphery 60" to the original trochoid surface 30 and the rotor periphery 60 is shown in FIG. 6. FIG. 6 is essentially similar to FIG. 4 except that in FIG. 6 the modified trochoid surface 30" is also displaced outwardly of the original trochoid surface 30 at the two ends of the trochoid major axis $y—y$, that is, at the points 33 and 34. Also in the regions designated by he letter $c$, the modified trochoid surface 30" (as illustrated) is displaced slightly inwardly of the original trochoid surface 30. In the region of the two ends of the minor axis $x—x$, that is, in the region of the near-axis points 31 and 32, the modified trochoid surface 30" of FIG. 6 is essentially similar to the modified trochoid surface 30' of FIG. 4.

The embodiment of FIG. 6 has the advantage over that of FIG. 4 in that the reduction in the maximum volume of each working chamber 38 because of the bulge or increased size of the modified periphery of the rotor is compensated in FIG. 6 by the outward bulge in the trochoid surface 30" compared with the original trochoid surface 30 in the region of the trochoid major axis $y—y$.

In the foregoing discussion of the two forms of the invention (FIGS. 4 and 6) it has been assumed that original trochoid surface 30 is an outer curve parallel to a true two-lobed epitrochoid 30*a* (see FIG. 1) and that the sine curve $s$ is superimposed on this parallel curve in the partial regions between the points E and F and between the points E' and F' as in FIG. 4 or over the entire length of the trochoid curve as in FIG. 6. This relationship is shown to be an enlarged scale in FIG. 7. Preferably, the crest radius $r$ of the apex seal 40 is made smaller than the parallel spacing $d$ of the true epitrochoid 30*a* and the parallel curve epitrochoid 30 thereby differing from the outer parallel curve shown in aforementioned U.S. Pat. No. 2,988,008 to Wankel. By making the radius $r$ smaller than said spacing $d$, the required radial movement of the apex seals 40 to maintain contact with the modified trochoid 30' of FIG. 4 or 30" of FIG. 6 is minimized. Thus, in FIG. 6 the distance $w$ indicates the amount of radially outward movement required of each apex seal to maintain contact with the modified trochoid surface 30" at the ends of the trochoid axis.

FIG. 8 is a view similar to FIG. 7 but showing that essentially the same modified trochoid surface 30' or 30" can also be otained by first superimposing the sine curve on the true epitrochoid surface 30*a* and to form the modified surface 30*a'* and then providing an outer parallel curve to this modified surface to form the modified trochoid surfaces 30' or 30". In FIG. 8 as in FIG. 7 the tip radius of the apex seal 40 is smaller than the spacing $d$ of said parallel curves to minimize the required radial movements of the apex seals 40 to maintain contact with the modified throchoid surfaces 30' or 30".

It should be understood that this invention is not limited to the specific details herein disclosed and that changes and modifications may occur to one skilled in the art without departing from the spirit or scope of the invention. We aim in the appended claims to cover all such modifications.

We claim:

1. A rotary mechanism for compressors, fluid motors, combustion engines or the like and comprising:

a. an outer body having an internal cavity, the inner peripheral surface of which has a two-lobed profile;

b. an inner body mounted for relative rotation within said outer body cavity;

c. a shaft coaxial with said outer body cavity and having an eccentric portion within said cavity on which said inner body is journaled with said inner body having an external periphery which is substantially the inner envelope of said two-lobed peripheral surface of the outer body such that said inner body has three circumferentially-spaced apex portions;

d. seal means provided at the apex portions of the inner body and having arcuate tip portions for sealing engagement with said two-lobed peripheral surface to form a plurality of working chambers between the inner and outer bodies;

e. said two-lobed peripheral surface being a modified epitrochoid surface having a minor axis intersecting the modified epitrochoid surface at two points disposed relatively near to the shaft axis and having a major axis intersecting the epitrochoid surface at two points disposed relatively remote from the shaft axis; and f. the two-lobed modified epitrochoid surface being characterized in that at least in a region twenty degrees on each side of the two near-axis points, it results from modifying an epitrochoid profile by displacing it radially outwardly by superimposing a continuous curve having successive maximum and minimum points in such a way that two adjacent minima of said curve are located at the two ends of said modified region and the maximum of said curve between said two minima is located on said minor axis and such that at said ends the second derivative of the equation of the basic trochoid and superimposed curve are approximately equal.

2. A rotary mechanism as claimed in claim 1 in which the modified epitrochoid surface results from modifying an epitrochoid profile by superimposing said curve over the entire periphery of said epitrochoid profile such that the maxima of said curve are disposed radially outside of the epitrochoid profile at each of the two near-axis points of said profile and at each of the two remote-axis points of said profile.

3. A rotary mechanism as claimed in claim 1 wherein the epitrochoid profile prior to its said modification is a surface disposed parallel to and radially outward of a true epitrochoid with the spacing between said parallel surface and epitrochoid being greater than the radius of the arcuate tips of each apex seal.

4. A rotary mechanism as claimed in claim 1 wherein the modified epitrochoid surface engaged by the apex seals is a surface disposed parallel to and radially outwardly of a surface obtained by modifying an epitrochoid surface by superimposing a curve as described in claim 5.

5. A rotary mechanism as claimed in claim 1 in which said continuous curve in a sine curve.

* * * * *